US009454937B2

(12) United States Patent
Kim et al.

(10) Patent No.: US 9,454,937 B2
(45) Date of Patent: Sep. 27, 2016

(54) TIMING CONTROLLER, LIQUID CRYSTAL DISPLAY DEVICE HAVING THE SAME, AND DRIVING METHOD THEREOF

(71) Applicant: LG Display Co., Ltd., Yeongdeungpo-gu, Seoul (KR)

(72) Inventors: KyungRok Kim, Gyeonggi-Do (KR); SaiChang Yun, Daegu (KR); YouSung Nam, Gyeonggi-Do (KR); MoonSoo Chung, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 227 days.

(21) Appl. No.: 13/708,729

(22) Filed: Dec. 7, 2012

(65) Prior Publication Data

US 2013/0147864 A1 Jun. 13, 2013

(30) Foreign Application Priority Data

Dec. 8, 2011 (KR) ..... 10-2011-0131030

(51) Int. Cl.
*G09G 3/36* (2006.01)
*G09G 3/34* (2006.01)

(52) U.S. Cl.
CPC ..... *G09G 3/3607* (2013.01); *G09G 3/3406* (2013.01); *G09G 2320/0271* (2013.01); *G09G 2320/0646* (2013.01); *G09G 2330/021* (2013.01)

(58) Field of Classification Search
CPC ..... G09G 3/3607; G09G 3/3406; G09G 2320/0271; G09G 2320/0646; G09G 2330/021
See application file for complete search history.

(56) References Cited

U.S. PATENT DOCUMENTS

| | | | | |
|---|---|---|---|---|
| 6,340,996 | B1 * | 1/2002 | Nakamura | 348/675 |
| 7,408,530 | B2 * | 8/2008 | Yang | 345/63 |
| 7,808,459 | B2 * | 10/2010 | Lee et al. | 345/77 |
| 8,330,754 | B2 * | 12/2012 | Byun et al. | 345/211 |
| 2002/0071476 | A1 * | 6/2002 | Park | 375/130 |
| 2003/0063053 | A1 * | 4/2003 | Yamazaki et al. | 345/82 |
| 2003/0222840 | A1 * | 12/2003 | Koga | G09G 3/3696 345/89 |
| 2004/0113923 | A1 * | 6/2004 | Ha | G09G 3/3208 345/690 |
| 2005/0057486 | A1 * | 3/2005 | Aoki et al. | 345/102 |

(Continued)

FOREIGN PATENT DOCUMENTS

| | | | |
|---|---|---|---|
| CN | 101494033 | A | 7/2009 |
| CN | 101814267 | A | 8/2010 |

(Continued)

OTHER PUBLICATIONS

State Intellectual Property Office of the People's Republic of China, First Office Action, Chinese Patent Application No. 201210524336.9, Jul. 30, 2014, twenty-three pages.

*Primary Examiner* — Kevin M Nguyen
*Assistant Examiner* — Sejoon Ahn
(74) *Attorney, Agent, or Firm* — Fenwick & West LLP

(57) ABSTRACT

A timing controller capable of adjusting luminance of a maximum gradation according to an amount of white of image data to thus enhance picture quality and reduce power consumption of a liquid crystal display device, a liquid crystal display device having the same, and a driving method thereof are provided. The timing controller includes: a gamma adjusting unit for receiving image data and a plurality of driving signals input from the outside, generating a gate control signal and a data control signal according to the plurality of driving signals, adjusting luminance according to an amount of white in the image data, and generating a corresponding gamma control signal.

20 Claims, 9 Drawing Sheets

(56) References Cited

U.S. PATENT DOCUMENTS

| | | | | |
|---|---|---|---|---|
| 2007/0120808 | A1* | 5/2007 | Shimoda et al. | 345/102 |
| 2008/0122813 | A1* | 5/2008 | Kim et al. | 345/204 |
| 2008/0180462 | A1* | 7/2008 | Nose | G09G 3/3688 345/690 |
| 2009/0079873 | A1* | 3/2009 | Otawara | 348/678 |
| 2009/0153593 | A1* | 6/2009 | Lee et al. | 345/690 |
| 2009/0184917 | A1* | 7/2009 | Park et al. | 345/102 |
| 2009/0237423 | A1* | 9/2009 | Shih | G09G 3/3406 345/690 |
| 2010/0002148 | A1* | 1/2010 | Otawara et al. | 348/678 |
| 2010/0039455 | A1* | 2/2010 | Ahn | 345/690 |
| 2010/0066752 | A1* | 3/2010 | Watanuki | 345/589 |
| 2010/0321532 | A1* | 12/2010 | Hashimoto et al. | 348/234 |
| 2011/0025732 | A1* | 2/2011 | Wang | 345/691 |
| 2013/0076803 | A1* | 3/2013 | Lee | G09G 3/3233 345/690 |
| 2013/0147864 | A1* | 6/2013 | Kim | G09G 3/3607 345/691 |

FOREIGN PATENT DOCUMENTS

| | | | |
|---|---|---|---|
| CN | 102081258 | A | 6/2011 |
| KR | 10-2010-0095093 | A | 8/2010 |
| KR | 10-2011-0078709 | A | 7/2011 |
| KR | 10-2011-0093290 | A | 8/2011 |

* cited by examiner

FIG. 6

❑ Dynamic gamma value

| GAMMA VOLTAGE | RELATED ART REFERENCE GAMMA VOLTAGE(V) | PATTERN 1 | PATTERN 2 |
|---|---|---|---|
| | | | |
| GMA1 | 15.89 | 15.89 | 15.89 |
| GMA3 | 14.11 | 14.18 | 14.22 |
| GMA4 | 13.38 | 13.36 | 13.42 |
| GMA5 | 12.32 | 12.25 | 12.31 |
| GMA7 | 10.36 | 10.14 | 10.18 |
| GMA9 | 8.41 | 8.41 | 8.41 |
| GMA10 | 7.62 | 7.62 | 7.62 |
| GMA12 | 6.07 | 6.24 | 6.22 |
| GMA13 | 2.97 | 4.04 | 3.98 |
| GMA15 | 2.81 | 2.83 | 2.78 |
| GMA16 | 2.09 | 2.04 | 2.02 |
| GMA18 | 0.85 | 0.85 | 0.85 |
| V-COM | 6.98 | 6.98 | 6.98 |

(a)

| WHITE AREA(%) | INSTANTANEOUS POWER CONSUMPTION OF BLU(W) | | REDUCTION RATE OF POWER CONSUMPTION OF BLU(%) |
|---|---|---|---|
| | RELATED ART | PRESENT INVENTION | |
| 100 | 86.2 | 27.6 | 68.0 |
| 80 | 88.5 | 54.5 | 38.4 |
| 60 | 80.6 | 70.6 | 12.4 |
| 40 | 60.6 | 60.8 | -0.3 |
| 20 | 39.8 | 39.9 | -0.2 |

TIMING CONTROLLER, LIQUID CRYSTAL DISPLAY DEVICE HAVING THE SAME, AND DRIVING METHOD THEREOF

CROSS REFERENCE TO RELATED APPLICATION(S)

The present disclosure relates to subject matter contained in priority Korean Application No. 10-2011-0131030, filed on Dec. 8, 2011 which is herein expressly incorporated by reference in its entirety.

BACKGROUND

1. Field of the Invention

The present invention relates to a timing controller, a liquid crystal display device having the same, and a driving method thereof, and more particularly, to a timing controller capable of adjusting luminance of maximum gradation according to an amount of white of image data to thus enhance screen quality and reduce power consumption of a liquid crystal display device, a liquid crystal display device having the same, and a driving method thereof 2. Description of the Related Art A display device, a visual information transmission medium, refers to a device visually displaying data in the form of characters or diagrams on a surface of a Braun Tube.

In general, a flat display panel (FPD) device as an image display device which is thinner and more lightweight than a TV or a CRT (Cathode Ray Tube) includes a liquid crystal display (LCD) using liquid crystal, a plasma display panel (PDP) using gas discharge, an organic light emitting diode (OLED) device using an organic material based on a phenomenon that when a current flows to a phosphor organic compound, light is emitted, an electric paper display (EDP) using a phenomenon that charged particles within an electric field moves toward a positive electrode or a negative electrode, and the like.

An LCD device, one of the most typical FPD devices, displays a desired image by adjusting light transmittance of pixels arranged in an active matrix form by individually supplying data signals according to image information to the pixels.

Such an LCD device includes a liquid crystal panel for displaying image data provided from the outside and a driving circuit for driving the liquid crystal panel.

Meanwhile, in case of a CRT or a PDP, among the conventional display devices, when the amount of white is increased in an image data, luminance of white is gradually reduced, but in case of an LCD device, although the amount of white in image data is increased, the same level of white luminance is maintained.

Thus, when an amount of white over the entire screen is assumed to be, for example, 40%, maximum luminance may be maintained at 450 nit, implementing brighter and more sharp picture quality relative to a CRT or a PDP.

However, as mentioned above, when the amount of white is increased in image data, a bright image dazzles the user's eyes and makes the user feel easily tired, and a rather too brighter and stimulating image is displayed relative to a CRT or a PDP.

Also, when the amount of white is increased in image data in the LCD, since the same level of white luminance is maintained, luminance is unnecessarily maintained, resulting in a waste of power.

In order to solve this problem, various techniques for reducing screen luminance have been presented. One of the techniques is an average picture level (APL) technique. According to APL technique, gray level values corresponding to image data are added up and the sum is divided by the number of image data to obtain an average gray level value of the image data, and luminance of a backlight unit is set accordingly.

However, in the case of the APL technique, backlight luminance of even an image in which image data has a high average gray level value is lowered, rather than a bright image having a great deal of white components in image data, degrading picture quality as an advantage of an LCD screen. Namely, a maximum output of the backlight unit is lowered to reduce a difference in luminance between gray levels in a high gray level region, resulting in a degradation of picture quality.

SUMMARY OF THE INVENTION

An aspect of the present invention provides a timing controller capable of adjusting luminance of maximum gradation according to an amount of white of image data to thus enhance screen quality of a liquid crystal display device, a liquid crystal display device having the same, and a driving method thereof.

Another aspect of the present invention provides a timing controller capable of adjusting luminance of maximum gradation according to an amount of white of image data to thus reduce power consumption of a liquid crystal display device, a liquid crystal display device having the same, and a driving method thereof.

According to an aspect of the present invention, there is provided a timing controller including: a gamma adjusting unit for receiving image data and a plurality of driving signals input from the outside, generating a gate control signal and a data control signal according to the plurality of driving signals, adjusting luminance according to an amount of white in the image data, and generating a corresponding gamma control signal.

The gamma adjusting unit may include: a pixel analyzing unit for counting the number of data having a gradation value equal to or greater than a reference gradation value in the image data; a backlight gain setting unit for setting a gain according to the counted number of data and generating a corresponding luminance control signal; a gamma curve adjusting unit for generating a gamma control signal having adjusted luminance according to the luminance control signal; and a screen adjusting unit for outputting a light source driving signal according to the gain value output from the backlight gain setting unit.

The pixel analyzing unit may store the number of data in a temporary buffer.

The backlight gain setting unit may set a gain by dividing data into a plurality of sections according to the number of the data.

The backlight gain setting unit may multiply the gain by a luminance adjustment value and generate a luminance control signal according to the corresponding result.

The screen adjusting unit may be a finite impulse response (FIR) filter.

The gain may be information for determining the light source driving signal.

The gamma adjusting unit may include a luminance adjusting unit for generating a reference gain by applying a luminance adjustment algorithm to the image data.

The luminance adjustment algorithm may be any one selected from among ambient light sensor (ALS) integration, global dimming (GL), and local dimming (LD).

According to another aspect of the present invention, there is provided a liquid crystal display (LCD) device including: a liquid crystal panel displaying an image; a timing controller including a gamma adjusting unit for receiving image data and a plurality of driving signals input from the outside, generating a gate control signal and a data control signal according to the plurality of driving signals, adjusting luminance according to an amount of white in the image data, and generating a corresponding gamma control signal; a gamma voltage generating unit for generating a plurality of reference gamma voltages according to the gamma control signal; a gate driving unit for driving gate lines of the liquid crystal panel according to the gate control signal; and a data driving unit for driving data lines of the liquid crystal panel according to the data control signal.

The gamma adjusting unit may include: a pixel analyzing unit for counting the number of data having a gradation value equal to or greater than a reference gradation value in the image data; a backlight gain setting unit for setting a gain according to the counted number of data and generating a corresponding luminance control signal; a gamma curve adjusting unit for generating a gamma control signal having adjusted luminance according to the luminance control signal; and a screen adjusting unit for outputting a light source driving signal according to the gain value output from the backlight gain setting unit.

The pixel analyzing unit may store the number of data in a temporary buffer.

The backlight gain setting unit may set a gain by dividing data into a plurality of sections according to the number of the data.

The backlight gain setting unit may multiply the gain by a luminance adjustment value and generate a luminance control signal according to the corresponding result.

The gamma adjusting unit may include a luminance adjusting unit for generating a reference gain by applying a luminance adjustment algorithm to the image data.

The gamma voltage generating unit may include: a reference gamma voltage generating unit for generating a plurality of reference gamma voltages according to the gamma control signal provided from the timing controller; and a gamma buffer unit for outputting a plurality of reference gamma voltages stabilized by buffering the plurality of reference gamma voltages.

According to another aspect of the present invention, there is provided a method for driving a liquid crystal display (LCD) device, including: counting the number of data having a gradation value equal to or greater than a reference gradation value in image data provided from the outside; calculating a gain according to the number of data; multiplying the gain by a luminance adjustment value to generate a luminance control signal according to the corresponding result; and generating a gamma control signal having adjusted luminance according to the luminance control signal.

The method may further include: generating a light source driving signal for preventing a flicker phenomenon of a screen upon receiving the gain.

The method may further include: temporarily storing the counted number of data in a buffer, after counting the number of data.

In calculating the gain, the gain may be set by dividing data into a plurality of sections according to the number of data.

According an embodiment of the present invention, the timing controller, the liquid crystal display device having the same, and the driving method thereof can provide an advantage of enhancing picture quality of a liquid crystal display device by adjusting luminance of a maximum gradation according to an amount of white in image data.

According an embodiment of the present invention, the timing controller, the liquid crystal display device having the same, and the driving method thereof can provide an advantage of reducing power consumption of a liquid crystal display device by adjusting luminance of a maximum gradation according to an amount of white in image data.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 is a table for explaining a gamma curve adjusting unit according to an embodiment of the present invention.

DETAILED DESCRIPTION OF THE INVENTION

Hereinafter, a timing controller, a liquid crystal display (LCD) device having the same, and a driving method thereof will be described in detail with reference to the accompanying drawings.

Figure 1:
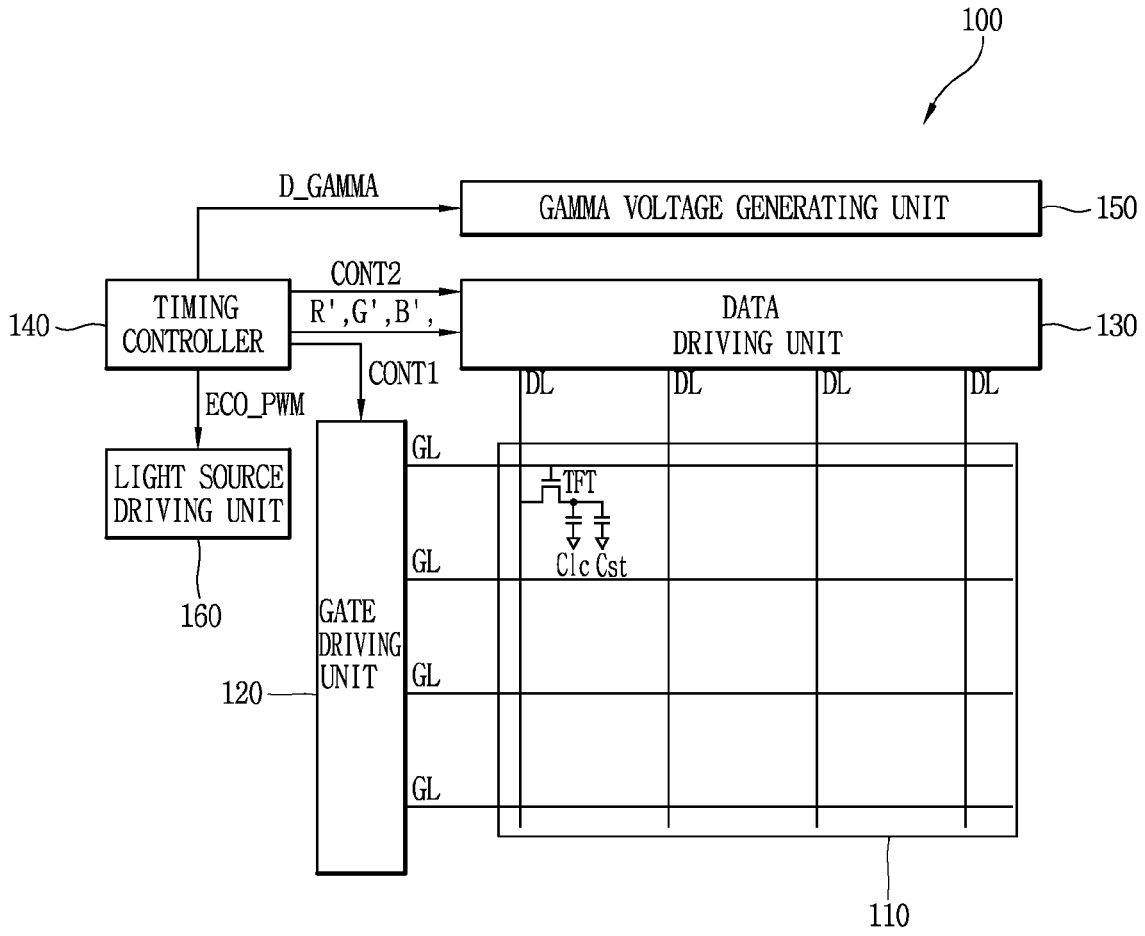
FIG. 1 is a block diagram of a liquid crystal display (LCD) device according to an embodiment of the present invention.
Figure 2:
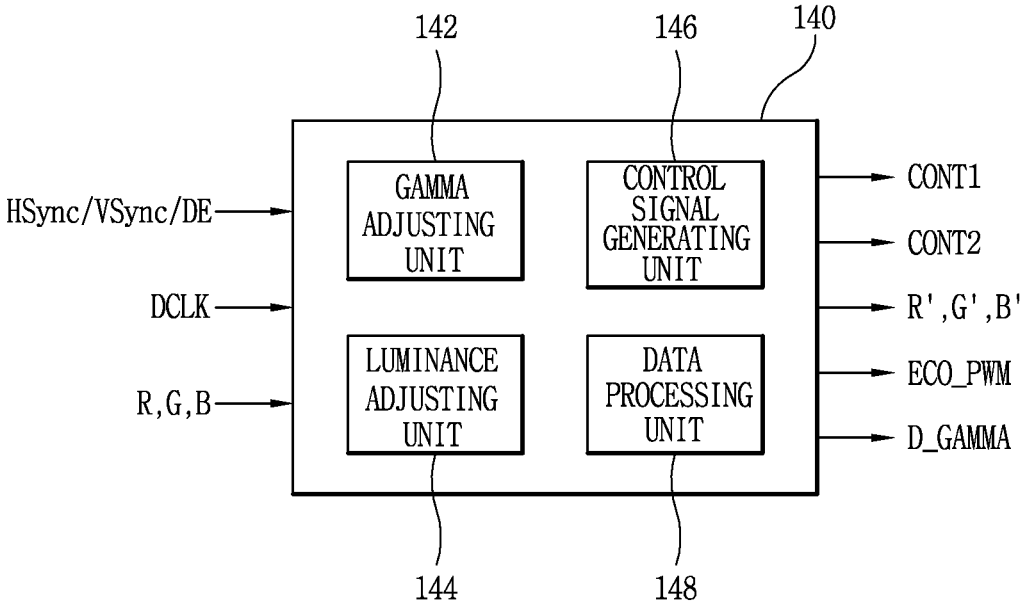
FIG. 2 is a block diagram of a timing controller according to an embodiment of the present invention.
Figure 3:
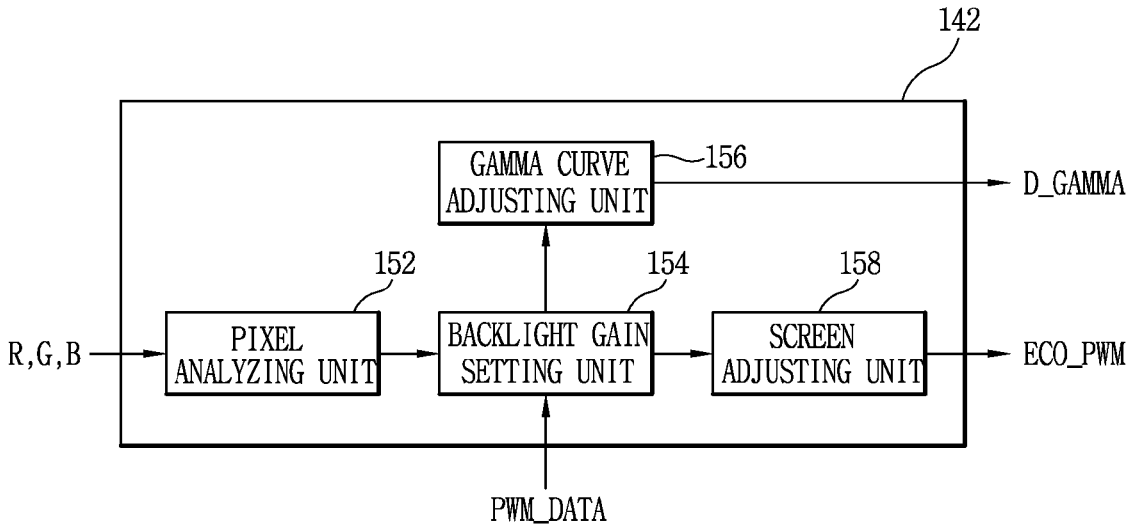
FIG. 3 is a block diagram of a gamma adjusting unit according to an embodiment of the present invention.
Figure 4:
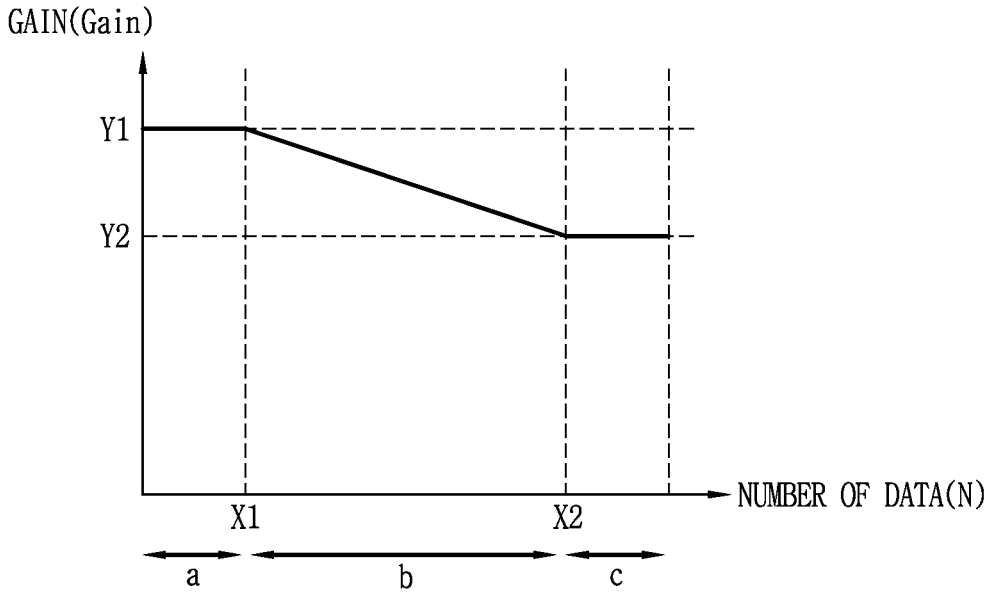
FIG. 4 is a graph showing setting of a gain according to the number of white data by a backlight gain setting unit according to an embodiment of the present invention.

FIG. 1 is a block diagram of a liquid crystal display (LCD) device according to an embodiment of the present invention. FIG. 2 is a block diagram of a timing controller according to an embodiment of the present invention. FIG. 3 is a block diagram of a gamma adjusting unit according to an embodiment of the present invention. FIG. 4 is a graph showing setting of a gain according to the number of white data by a backlight gain setting unit according to an embodiment of the present invention.

As illustrated in FIG. 1, an LCD device 100 according to an embodiment of the present invention includes a liquid crystal panel 110 including liquid crystal cells arranged in a matrix form between two glass substrates to display an image, a light source (not shown) for irradiating light to the liquid crystal panel 110, driving units 120, 130 for applying a plurality of driving signals to drive the liquid crystal panel 110, timing controller 140, gamma voltage generating unit 150, and light source driving unit 160.

When viewed from an equivalent circuit, the liquid crystal panel 110 includes a plurality of display signal lines GL and DL and a plurality of unit pixels arranged in a matrix form and connected to the display signal lines GL and DL.

Here, the display signal lines GL and DL include a plurality of gate lines GL transferring gate signals and a plurality of data lines DL transferring data signals. The gate lines GL extend in a row direction and are substantially parallel to each other, and the data lines DL extend in a column direction and are substantially parallel to each other.

Each unit pixel includes a switching element (thin film transistor (TFT)) connected to the display signal lines GL and DL, a liquid crystal capacitor Clc and a storage capacitor Cst connected to the TFT. The storage capacitor Cst may be omitted as necessary.

The switching element TFT is provided in a TFT substrate, which is a three-terminal element. A control terminal and a providing terminal of the switching element TFT are connected to the gate line GL and the data line DL and an output terminal thereof is connected to the liquid crystal capacitor Clc and the storage capacitor Cst.

The liquid crystal capacitor Clc uses a pixel electrode of the TFT substrate and a common electrode of a color filter substrate as two terminals, and a liquid crystal layer between the two electrodes serves as a dielectric material. The pixel electrode is connected to the switching element TFT, and the common electrode is formed on a front surface of the color filter substrate and receives a common voltage Vcom. Here, the common electrode may be provided on the TFT substrate, and in this case, the two electrodes are formed to have a linear or bar shape.

The storage capacitor Cst is formed as a separate signal line (not shown) provided on the TFT substrate and the pixel electrode overlaps, and a determined voltage such as a common voltage Vcom, or the like, is applied to the separate signal line. However, the storage capacitor Cst may also be formed as the pixel electrode overlaps with an immediately upper front stage gate line by the medium of an insulator.

Meanwhile, in order to implement a color representation, each unit pixel is required to represent color, and to this end, red, green, or blue color filters are provided in a region corresponding to the pixel electrode. Here, the color filters may be formed in a corresponding region of the color filter substrate or may be formed above or below the pixel electrode of the TFT substrate.

A polarizer (not shown) for polarizing light is attached to an outer surface of at least one of the TFT substrate and the color filter substrate.

Also, driving units of the LCD device 100 include the gate driving unit 120 for sequentially supplying gate driving signals to the plurality of gate lines GL formed on the liquid crystal panel 110, the data driving unit 130 for supplying analog image data R, G, and B to the plurality of data lines DL such that the analog image data R, G, and B are synchronized with the gate driving signals, the timing controller 140 for arranging the digital image data R, G, and B provided from the outside to supply the same to the data driving unit 130 and controlling driving of the gate driving unit 120, the data driving unit 130, the gamma voltage generating unit 150, and the light source driving unit 160, the gamma voltage generating unit 150 for supplying a plurality of reference gamma voltages to the data driving unit 130, and the light source driving unit 160 for supplying a driving voltage to a light source.

The timing controller 140 arranges image data provided from the outside such that the image data fits for driving of the liquid crystal panel 100, and supplies the same to the data driving unit 130. Also, the timing controller 140 generates a gate control signal CONT1 and a data control signal CONT2 by using a dot clock DLCK (not shown), a data enable signal DE (not shown), and horizontal and vertical synchronization signals Hsync and Vsync (not shown) provided from the outside, and controls a driving timing of each of the data driving unit 130 and the gate driving unit 120.

In addition, the timing controller 140 according to an embodiment of the present invention includes a gamma adjusting unit (not shown) for adjusting luminance of maximum gradation according to an amount of white of image data to enhance picture quality and reduce power consumption. Details thereof will be described with reference to FIGS. 2 through 10B.

The gate driving unit 120 includes a shift register sequentially generating gate driving signals in response to the gate control signal CONT1 from the timing controller 140. In response to the gate control signal CONT1 provided from the timing controller 140, the gate driving unit 120 sequentially applies gate driving signals to the plurality of gate lines GL to turn on the TFTs connected to the respective gate lines GL.

In response to the data control signal CONT2 provided from the timing controller 140, the data driving unit 130 converts digital image data R', G', B' provided from the timing controller 140 into an analog image signal, and supplies analog image signals of corresponding horizontal lines to the plurality of data lines DL at every period at which a gate driving signal is supplied to the plurality of gate lines GL.

Here, in response to a polarity control signal POL (not shown) supplied from the timing controller 140, the data driving unit 130 may reverse the polarity of the analog image signal supplied to the plurality of data lines DL.

The gamma voltage generating unit 160 receives a gamma control signal D_GAMMA provided from the timing controller 140 and outputs a plurality of reference gamma voltages GMA (not shown).

Here, the gamma voltage generating unit 160 includes a reference gamma voltage generating unit (not shown) for generating a plurality of reference gamma voltages and a gamma buffer unit (not shown) for buffering the reference gamma voltages generated by the reference gamma voltage generating unit to output stabilized reference gamma voltages.

The reference gamma voltage generating unit includes a plurality of resistors connected in series between a supply voltage source VDD and a ground voltage source GND. The reference gamma voltages GMA of multiple stages having different voltage values according to a plurality of resistance values are generated from nodes between the plurality of resistors. Thus, the reference gamma voltage generating unit divides the supply voltages provided from the supply voltage source VDD by a plurality of stages by using the plurality of resistors and supplies the same to the gamma buffer unit.

The gamma buffer unit is connected in series to an output line of the reference gamma voltage generating unit, and may be configured as, for example, a voltage follower, or the like. The voltage follower serves to buffer the plurality of reference gamma voltages GMA to stabilize them, and the plurality of buffered reference gamma voltages GMA are supplied to the data driving unit 130.

Here, although not shown, the gamma voltage generating unit and the data driving unit 130 are electrically connected by a plurality of tape carrier package (TCP), and a plurality of transmission lines for transmitting the reference gamma voltages are formed at the respective output terminals of the gamma buffer unit. Thus, the plurality of reference gamma voltages GMA buffered by the gamma buffer unit are supplied to the data driving unit 130 by way of the plurality of gamma voltage transmission lines and a plurality of TCPs.

In general, gamma refers to a slope of a luminance characteristics curve according to a voltage level output from an output terminal of the data driving unit 130 and a variation (or a deviation) of luminance values. In order to generate a desired gamma voltage value, the gamma voltage generating unit of the general LCD device 100 should accurately select values of gamma resistance, and also, in order to generate a stable reference gamma voltage, a capacitor may be additionally provided at a gamma power input terminal and a gamma power output terminal, as well as the gamma resistor and the gamma buffer unit.

The light source driving unit 160 receives a light source driving signal ECO_PWM for controlling a plurality of light sources, e.g., LEDs, from the timing controller 140, and drives the plurality of light sources (not shown).

In the LCD device 100, digital image data output from the timing controller 140 is converted by the data driving unit 130 into analog image data, and the converted analog image data is supplied to the plurality of data lines DL to display a desired image on the liquid crystal panel 110. Here, the data driving unit 130 converts the digital image data into the analog image data by using positive polarity and negative polarity reference gamma voltages supplied from the gamma voltage generating unit 160, as reference voltages, and supplies the same, and the liquid crystal panel 110 displays an image by using the supplied analog image data.

As illustrated in FIGS. 2 and 3, the timing controller 140 according to an embodiment of the present invention receives the dot clock DLCK, the data enable signal DE, the horizontal and vertical synchronization signals Hsync and Vsync, and the image data R, G, and B from the outside, and outputs the gate control signal CONT1, the data control signal CONT2, image data R', G', and B' having converted data format, the light source driving signal ECO_PWM, and the gamma control signal D_GAMMA.

Also, the timing controller 140 includes a gamma adjusting unit 142, a luminance adjusting unit 144, a control signal generating unit 146, and a data processing unit 148.

The gamma adjusting unit 142 adjusts luminance of maximum gradation according to an amount of white among the image data R, G, and B. As shown in FIG. 3, the gamma adjusting unit 142 includes a pixel analyzing unit 152, a backlight gain setting unit 154, a gamma curve adjusting unit 156, and a screen adjusting unit 158.

Here, the pixel analyzing unit 152 is a block for analyzing an amount of pixels making a user feel dazzled in one screen. The pixel analyzing unit 152 counts the number of data having a gradation value equal to or higher than a reference gradation value in the image data R, G, and B provided from the outside, and temporarily stores the count result in a buffer (not shown). Here, although not shown, the buffer may be provided in the pixel analyzing unit 152. For example, when the reference gradation value is set to 230, the pixel analyzing unit 152 counts the number of data having a gradation value equal to or higher than 230 in the image data R, G, and B.

The backlight gain setting unit 154 calculates a gain GAIN according to the number of data counted by the pixel analyzing unit 152. Here, the gain may be expressed as a number, for example, 1, 0.8, or the like.

As illustrated in FIG. 4, numbers of data having gradation values equal to or higher than the reference gradation value in the image R, G, and B are divided into a plurality of sections a, b, and c, and corresponding gains may be set. Here, X1 and X2 indicate the numbers of data having a gradation value equal to or higher than the reference gradation value, and Y1 and Y2 indicate gains, respectively.

When the number of data having a gradation value equal to or higher than the reference gradation value in the image data R, G, and B is included in the first section a, a gain thereof is set to Y1. When the number of data having a gradation value equal to or higher than the reference gradation value in the image data R, G, and B is included in the second section b, a gain thereof is set to a value between Y1 and Y2. Also, when the number of data having a gradation value equal to or higher than the reference gradation value in the image data R, G, and B is included in the third section c, a gain thereof is set to Y2.

Here, when the number of data is included in the third section c, the gain may be reduced by about, for example, 20% in comparison to the case in which the number of data is included in the first section a. For example, on the assumption that a gradation value of white in 8-bit data is 255 and maximum luminance is 450 nit, when luminance of white having the gradation value 255 is set to 392 nit from 450 nit, if the number of data is included in the first section a, it is set to have the original maximum luminance 450 nit. However, when the number of data is included in the third section c, the luminance is set to be low to 392 nit from the maximum luminance 450 nit, so it can be seen that the gain is reduced by about 20%.

Also, the backlight gain setting unit 154 multiplies the gain GAIN by a luminance adjustment value PWM_DATA provided from the luminance adjusting unit 144 to generate a luminance control signal for adjusting luminance of a light source according to the result. Here, the gain GAIN and the PWM_DATA indicate information for determining the light source driving signal ECO_PWM.

The gamma curve adjusting unit 156 minutely adjusts luminance according to a luminance control signal provided from the backlight gain setting unit 154. Namely, the gamma curve adjusting unit 158 provides a gamma control signal D_GAMMA having luminance that has been adjusted according to the luminance control signal, to the gamma voltage generating unit 160. Then, the reference gamma voltage generating unit provided in the gamma voltage generating unit 160 generates a plurality of reference gamma voltages GMA according to the gamma control signal D_GAMMA provided from the gamma curve adjusting unit 156.

The screen adjusting unit 158 receives the gain GAIN and the luminance adjustment value PWM_DATA output from the backlight gain setting unit 154 and outputs the light source driving signal ECO_PWM for preventing a flicker phenomenon of the screen generated when luminance of a light source is adjusted.

As described above, the backlight gain setting unit 154 changes the luminance value of the maximum gradation, and here, when the luminance value of the maximum gradation is rapidly changed, a flicker phenomenon in which the screen flickers occurs. Thus, in order to prevent the flicker phenomenon, the screen adjusting unit 158 is required. Here, the screen adjusting unit 158 may be configured as an FIR (Finite Impulse Response) filter for preventing flicker.

Also, the screen adjusting unit 158 receives the luminance adjustment value PWM_DATA from the backlight gain setting unit 154. Here, the luminance value of the gradation corresponding to the luminance adjustment value PWM_DATA provided from the luminance adjusting unit 144 may also have a flicker phenomenon in which the screen flickers, so in order to prevent this, the screen adjusting unit 158 is required.

The luminance adjusting unit 144 is a block for adjusting luminance of a light source. The luminance adjusting unit 144 receives the image data R, G, and B from the outside, generates a corresponding luminance adjustment value PWM_DATA, and provides the generated luminance adjustment value PWM_DATA to the backlight gain setting unit 154.

Here, the luminance adjusting unit 144 may be implemented with various algorithms, and ALS (Ambient Light Sensor) Integration, GL (Global Dimming), and LD (Local dimming) technique may be used. Here, according to the ALS, an external light sensor may be installed in the liquid crystal panel 110 to adjust luminance of a light source according to sensing results of the external light sensor. The GL technique includes a technique such as Nth diming, which adjusts luminance of a light source according to a gray level displayed on the entire screen. In addition, the LD is a technique for dividing a screen into certain regions and adjusting luminance of a light source by certain regions according to gray levels displayed on the screen.

Also, the luminance adjusting unit 144 processes data corresponding to one of the algorithms mentioned above, and provides the same to the data processing unit 148.

The control signal generating unit 146 generates the gate control signal CONT1 and the data control signal CONT2 by using the dot clock DLCK, the data enable signal DE, the horizontal synchronization signal Hsync, the vertical synchronization signal Vsync, and a pre-running method select signal RBF provided from an external system.

Here, the gate control signal CONT1 includes a gate start pulse (GSP), a gate shift clock (GSC), and a gate output enable (GOE) signal.

The data control signal CONT2 includes a source start pulse (SSP), a source shift clock (SSC), a source output enable (SOE) signal, a source start pulse left (SSPL), and a polarity signal (POL). Besides, the control signal generating unit 146 may generate a power management signal DPM and an inverter left/right signal UDO.

The data processing unit 110 receives image data provided from the luminance adjusting unit 144, arranges image data such that it fits for a data transmission method between the timing controller 140 and the liquid crystal panel 110, and transfers the same to the data driving unit 130.

Here, as the data transmission method between the timing controller 140 and the liquid crystal panel 110, RSDS (Reduced Swing Differential Signaling), LVDS (low-voltage differential signaling, or small signal differential signaling method such as mini-LVDS may be used, and data may be transmitted to the liquid crystal panel 110 by using any one selected from them.

Hereinafter, an operation of the gamma adjusting unit 142 according to an embodiment of the present invention will be described.

Figure 5:
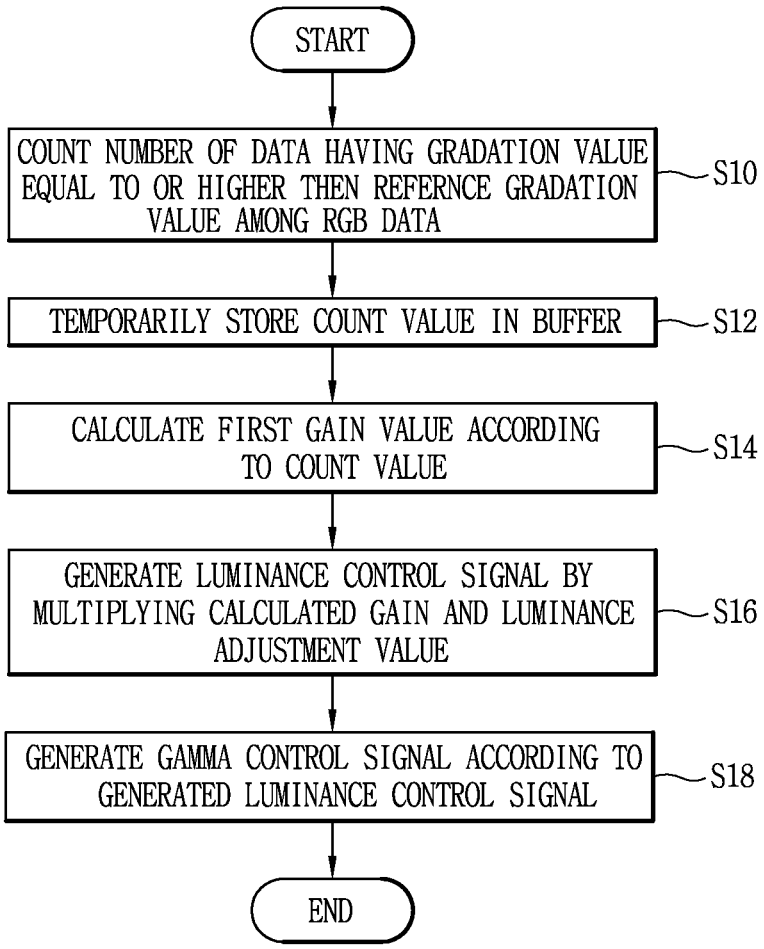
FIG. 5 is a flow chart illustrating an operation of the gamma adjusting unit according to an embodiment of the present invention.

FIG. 5 is a flow chart illustrating an operation of the gamma adjusting unit according to an embodiment of the present invention.

As illustrated in FIG. 5, first, the pixel analyzing unit 152 counts the number of data having a gradation value equal to or higher than the reference gradation value in the image data R, G, and B provided from the outside (S10), and temporarily stores the count value in a buffer (S12). For example, when the reference gradation value is set to 230, the pixel analyzing unit 152 counts the number of data having a gradation value equal to or higher than 230.

Next, the backlight gain setting unit 154 calculates a gain GAIN according to the count value stored in the buffer (S14).

As illustrated in FIG. 4, when the number of data having a gradation value equal to or higher than the reference gradation value in the image data R, G, and B is included in the first section a, a gain thereof is set to Y1. When the number of data having a gradation value equal to or higher than the reference gradation value in the image data R, G, and B is included in the second section b, a gain thereof is set to a value between Y1 and Y2. Also, when the number of data having a gradation value equal to or higher than the reference gradation value in the image data R, G, and B is included in the third section c, a gain thereof is set to Y2.

And then, the backlight gain setting unit 154 multiplies the gain GAIN by the luminance adjustment value PWM_DATA provided from the luminance adjusting unit 144 to generate a luminance control signal for adjusting luminance of a light source according to the results (S16).

Thereafter, the gamma curve adjusting unit 156 differently generates the gamma control signal D_GAMMA according to the luminance control signal provided from the backlight gain setting unit 154, and provides the same to the gamma voltage generating unit 160.

FIG. 6 is a table for explaining the gamma curve adjusting unit according to an embodiment of the present invention.

As illustrated in FIG. 6, it can be seen that, in the related art reference gamma voltages, the reference gamma voltages are generated without consideration of glare according to the amount of white of image data, and in an embodiment of the present invention, in order to minutely adjust luminance of a light source, gains are adjusted according to an amount of white of image data to generate corresponding reference gamma voltages.

Here, pattern 1 indicates image data in which black and white are represented in a certain ratio, and pattern 2 indicates image data representing only white.

Also, when the reference gamma voltages of the pattern 1 and the pattern 2 according to an embodiment of the present invention are compared with the related art reference gamma voltages, it can be seen that the other remaining reference gamma voltages, excluding first, ninth, tenth, and eighteenth reference gamma voltages, are increased or decreased by a certain value.

Thus, by adjusting the gain according to an amount of white of image data and minutely adjusting luminance of a light source by generating a reference gamma voltage corresponding to the adjusted gain, picture quality of the LCD device can be enhanced and power consumption of the LCD device can be reduced.

Figure 7:
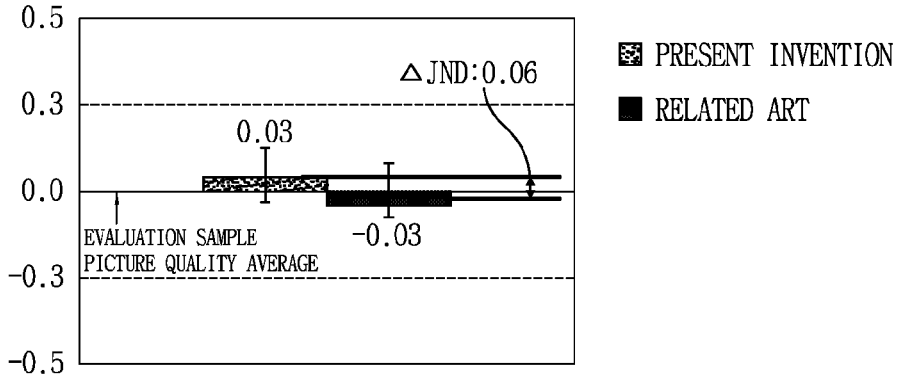
FIG. 7 is a view illustrating picture quality preference evaluation results according to an embodiment of the present invention.

FIG. 7 is a view illustrating picture quality preference evaluation results according to an embodiment of the present invention.

As illustrated in FIG. 7, an embodiment of the present invention in which a gain is adjusted according to an amount of white and a corresponding reference gamma voltage is generated has the same picture quality preference in comparison to the related art in which glare according to an amount of white of image data is not considered. Here, a difference between the picture quality of the related art and that of the present invention is, for example, 0.06 JND (Just Noticeable Difference), so it can be seen that there is little difference in the picture quality preference. Here, JND indicates a level at which 75% of observers can statistically recognize a difference in picture quality.

Figure 8:
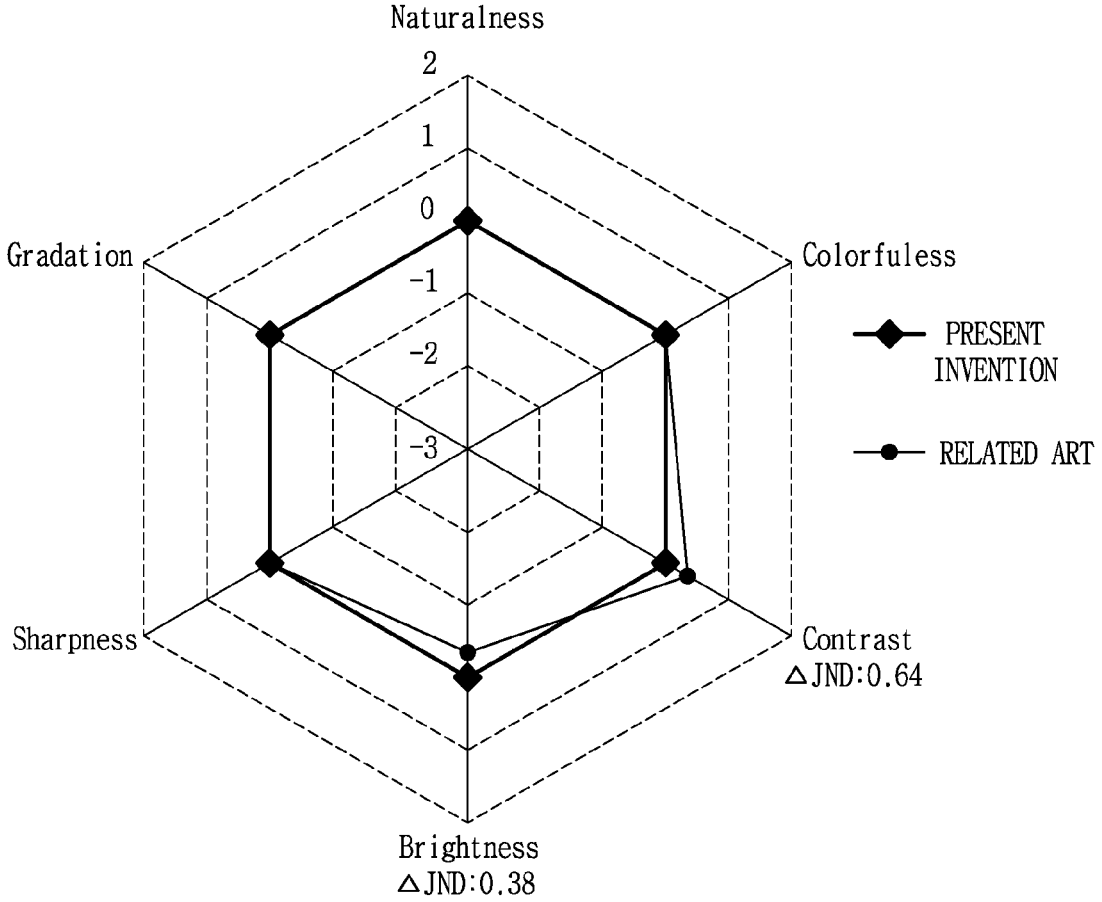
FIG. 8 is a view illustrating evaluation results of picture quality items according to an embodiment of the present invention.

FIG. 8 is a view illustrating evaluation results of picture quality items according to an embodiment of the present invention.

As illustrated in FIG. 8, in the present invention in which a gain is adjusted according to an amount of white and a corresponding reference gamma voltage is generated, naturalness indicating the degree of naturalness of color and texture, colorfulness indicating the colorfulness of color, various colors and a degree of darkness, sharpness indicating a boundary of an object or an expression of texture, gradation indicating linear characteristics according to a change in a gain of color or luminance according to an embodiment of the present invention have the same level as that of the related art.

Here, brightness indicating the degree of expressing the intensity of light and contrast indicating a difference between brightness and darkness of the present invention are evaluated to be low in comparison to the related art, but the luminance in consideration of glare is evaluated to be high by having a difference of 0.38 JND in comparison the related art.

Figures 9, 10A:
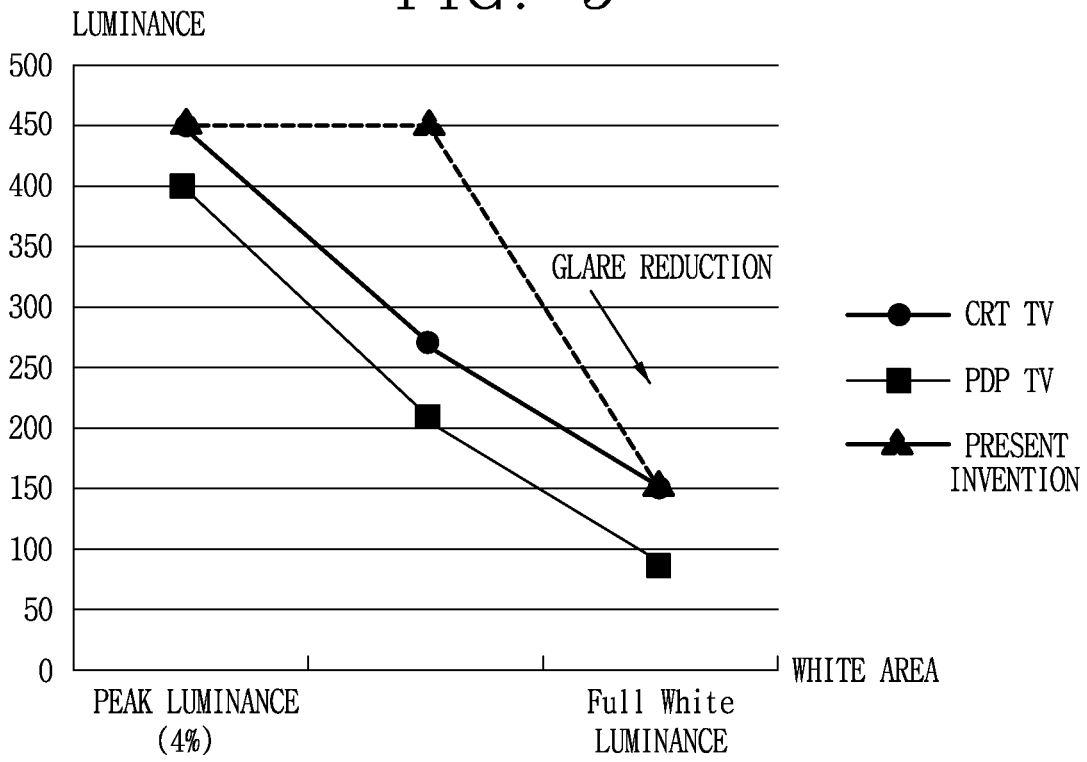
FIG. 9 is a graph showing a fine luminance adjustment according to an embodiment of the present invention.
FIGS. 10A and 10B are a table and a graph showing power consumption according to an embodiment of the present invention.

FIG. 9 is a graph showing a minute luminance adjustment according to an embodiment of the present invention.

As illustrated in FIG. 9, in case of a CRT and a PDP, when the amount of white in image data is increased, luminance of white is gradually reduced, and in the related art, when the amount of white in image data is increased, the same white luminance is maintained. In comparison, in an embodiment of the present invention, a gain is adjusted according to an amount of white and a corresponding reference gamma voltage is generated to minutely adjust luminance, whereby glare of the user can be reduced and fatigue of the user's eyes can be reduced.

Figure 10B:
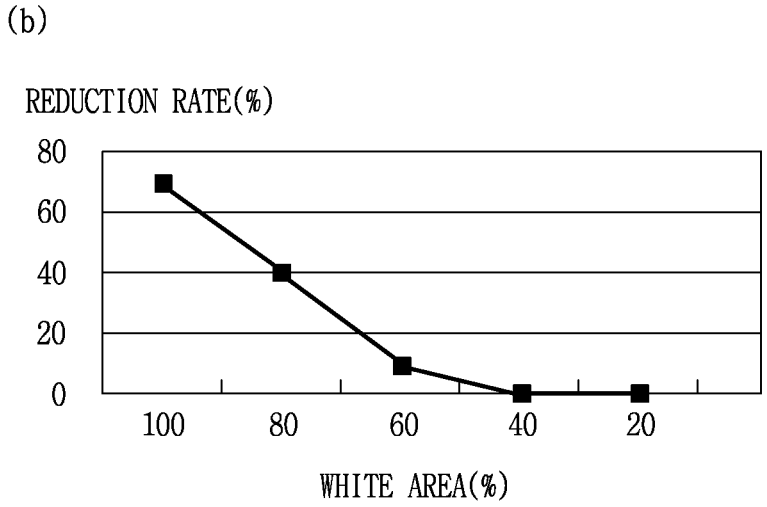

FIGS. 10A and 10B are a table and a graph showing power consumption according to an embodiment of the present invention.

As illustrated in FIGS. 10A and 10B, in an embodiment of the present invention, a gain is adjusted according to an amount of white and a corresponding reference gamma voltage is generated to minutely adjust luminance, whereby power consumption of a light source can be considerably reduced in comparison to the related art. Here, it can be seen that, in the related art, as the area of white is increased, power consumption is increased, but in the present invention, as the area of white is increased, power consumption is reduced.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A timing controller comprising:

a gamma adjusting circuit configured to receive image data and adjust luminance according to an amount of white in the image data, and generate a gamma control signal for a gamma voltage generating circuit that generates a plurality of reference gamma voltages based on the gamma control signal, wherein the gamma adjusting circuit comprises:

a pixel analyzing circuit configured to count a number of data having a gradation value equal to or greater than a reference gradation value in the image data;

a backlight gain setting circuit configured to set a gain according to a section to which the counted number of data belongs, and generate a luminance control signal based on the gain; and a gamma curve adjusting circuit configured to generate the gamma control signal according to the luminance control signal generated by the backlight gain setting circuit based on the gain.

2. The timing controller of claim 1, wherein the gamma adjusting circuit comprises:

a screen adjusting circuit configured to output a light source driving signal according to the gain set by the backlight gain setting circuit.

3. The timing controller of claim 1, wherein the pixel analyzing circuit stores the number of data in a temporary buffer.

4. The timing controller of claim 2, wherein the backlight gain setting circuit sets the gain by dividing the data into a plurality of sections according to a numerical range to which the number of the data belongs.

5. The timing controller of claim 4, wherein the backlight gain setting circuit multiplies the gain by a luminance adjustment value and generates the luminance control signal according to a corresponding result.

6. The timing controller of claim 2, wherein the screen adjusting circuit is a finite impulse response (FIR) filter.

7. The timing controller of claim 2, wherein the gain is information for determining the light source driving signal.

8. The timing controller of claim 1, further comprising:

a luminance adjusting circuit configured to generate a reference gain by applying a luminance adjustment algorithm to the image data.

9. The timing controller of claim 8, wherein the luminance adjustment algorithm is any one of selected from among ambient light sensor (ALS) integration, global dimming (GL), and local dimming (LD).

10. A liquid crystal display (LCD) device comprising:

a liquid crystal panel displaying an image;

a timing controller configured to receive image data and a plurality of driving signals, and generate a gate control signal and a data control signal according to the plurality of driving signals; a gamma voltage generating circuit configured to generate a plurality of reference gamma voltages according to a gamma control signal; a gate driving circuit configured to drive gate lines of the liquid crystal panel according to the gate control signal; and a data driving circuit configured to drive data lines of the liquid crystal panel according to the data control signal, wherein the timing controller includes a gamma adjusting circuit configured to adjust luminance according to an amount of white in the image data and generate the gamma control signal for the gamma voltage generating circuit, and wherein the gamma adjusting circuit comprises:

a pixel analyzing circuit configured to count a number of data having a gradation value equal to or greater than a reference gradation value in the image data;

a backlight gain circuit configured to set a gain according to a section to which the counted number of data belongs and generate a corresponding luminance control signal based on the gain; and a gamma curve adjusting circuit configured to generate the gamma control signal for the gamma voltage generating circuit according to the luminance control signal generated by the backlight gain setting circuit based on the gain.

11. The device of claim 10, wherein the gamma adjusting circuit comprises:

a screen adjusting circuit configured to output a light source driving signal according to the gain set by the backlight gain setting circuit.

12. The device of claim 11, wherein the pixel analyzing circuit stores the number of the data in a temporary buffer.

13. The device of claim 11, wherein the backlight gain setting circuit sets the gain by dividing the data into a plurality of sections according to a numerical range to which the number of the data belongs.

14. The device of claim 11, wherein the backlight gain setting circuit multiplies the gain by a luminance adjustment value and generates the luminance control signal according to a corresponding result.

15. The device of claim 11, wherein the timing controller includes a luminance adjusting circuit configured to generate a reference gain by applying a luminance adjustment algorithm to the image data.

16. The device of claim 10, wherein the gamma voltage generating circuit comprises:

a reference gamma voltage generating circuit configured to generate a plurality of reference gamma voltages according to the gamma control signal provided from the timing controller; and a gamma buffer circuit configured to output a plurality of reference gamma voltages stabilized by buffering the plurality of reference gamma voltages.

17. A method for driving a liquid crystal display (LCD) device, the method comprising:

counting a number of data having a gradation value equal to or greater than a reference gradation value in image data;

calculating a gain according to a section to which the counted number of data belongs;

multiplying the gain by a luminance adjustment value to generate a luminance control signal according to a corresponding result of multiplying the gain by the luminance adjustment value; and generating a gamma control signal for a gamma voltage generating circuit according to the luminance control signal generated based on the gain, the gamma voltage generating circuit generating a plurality of reference gamma voltages based on the gamma control signal.

18. The method of claim 17, further comprising:

generating a light source driving signal for preventing a flicker phenomenon of a screen upon receiving the gain.

19. The method of claim 17, further comprising:

temporarily storing the counted number of data in a buffer, after counting the number of data.

20. The method of claim 17, wherein, in calculating the gain, the gain is set by dividing data into a plurality of sections according to a numerical range to which the number of data belongs.

* * * * *